US008195058B2

(12) United States Patent
Takenaka et al.

(10) Patent No.: US 8,195,058 B2
(45) Date of Patent: Jun. 5, 2012

(54) TONER FIXING DEVICE WITH LIGHT CONTROL MIRRORS AND IMAGE FORMING APPARATUS INCORPORATING SAME

(75) Inventors: Kohta Takenaka, Yokohama (JP); Kazunori Bannai, Atsugi (JP); Hidehiko Fujiwara, Tokyo (JP); Toshihiro Shimada, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 163 days.

(21) Appl. No.: 12/659,437

(22) Filed: Mar. 9, 2010

(65) Prior Publication Data

US 2010/0232822 A1 Sep. 16, 2010

(30) Foreign Application Priority Data

Mar. 13, 2009 (JP) ..... 2009-060768

(51) Int. Cl.
*G03G 15/20* (2006.01)

(52) U.S. Cl. ..... 399/69; 399/336

(58) Field of Classification Search ..... 399/336, 399/69, 67, 44, 43, 335, 338
See application file for complete search history.

(56) References Cited

U.S. PATENT DOCUMENTS 3,953,709 A * 4/1976 Elter ..... 219/216
6,151,466 A 11/2000 Fujiwara
6,542,712 B2 4/2003 Kamijo
6,658,222 B2 12/2003 Kamijo
6,731,900 B2 5/2004 Takenaka
6,731,902 B2 5/2004 Takenaka
6,788,916 B2 9/2004 Takenaka
6,801,744 B2 10/2004 Fujiwara
6,907,218 B2 6/2005 Fujiwara
7,013,108 B2 3/2006 Takenaka
2003/0026632 A1 2/2003 Takenaka
2003/0063933 A1 4/2003 Fujiwara
2003/0063934 A1 4/2003 Takenaka
2003/0099493 A1 5/2003 Takenaka (Continued)

FOREIGN PATENT DOCUMENTS

JP 58-190659 12/1983

(Continued)

OTHER PUBLICATIONS

Abstract of JP 2001-154517 published Jun. 8, 2001.

(Continued)

*Primary Examiner* — David Gray
*Assistant Examiner* — Billy J Lactaoen
(74) *Attorney, Agent, or Firm* — Harness, Dickey & Pierce, P.L.C.

(57) ABSTRACT

In a fixing device, a first reflection plate covers a part of an outer circumferential surface of an infrared heater in a circumferential direction of the infrared heater along an axial direction of the infrared heater substantially perpendicular to the circumferential direction of the infrared heater. The first reflection plate reflects light emitted by the infrared heater toward a fixing member. At least one light control mirror is provided in at least one end of the first reflection plate in an axial direction of the first reflection plate. At least one second reflection plate opposes the infrared heater via the at least one light control mirror to reflect the light emitted by the infrared heater and passing through the at least one light control mirror toward a center portion of the fixing member in an axial direction of the fixing member.

13 Claims, 7 Drawing Sheets

U.S. PATENT DOCUMENTS

| | | | | |
|---|---|---|---|---|
| 2003/0103786 | A1 | 6/2003 | Fujiwara | |
| 2004/0240914 | A1 | 12/2004 | Takenaka | |
| 2009/0116884 | A1* | 5/2009 | Nonaka et al. | 399/328 |
| 2009/0148207 | A1 | 6/2009 | Yamada | |
| 2009/0208264 | A1 | 8/2009 | Fujiwara | |
| 2010/0008691 | A1 | 1/2010 | Fujiwara | |

FOREIGN PATENT DOCUMENTS

| | | |
|---|---|---|
| JP | 08-027571 | 1/1996 |
| JP | 08-095412 | 4/1996 |
| JP | 09-185984 | 7/1997 |
| JP | 2001-201978 | 7/2001 |
| JP | 2003-009813 | 1/2003 |
| JP | 2003-107948 | 4/2003 |
| JP | 2003-207645 | 7/2003 |
| JP | 2004-095525 | 3/2004 |
| JP | 4099303 | 3/2008 |
| JP | 2008-129092 | 6/2008 |
| JP | 4221651 | 11/2008 |

OTHER PUBLICATIONS

Abstract of JP 2004-142678 published May 20, 2004.

* cited by examiner

TONER FIXING DEVICE WITH LIGHT CONTROL MIRRORS AND IMAGE FORMING APPARATUS INCORPORATING SAME

PRIORITY STATEMENT

The present patent application claims priority from Japanese Patent Application No. 2009-060768, filed on Mar. 13, 2009 in the Japan Patent Office, which is hereby incorporated herein by reference in its entirety.

BACKGROUND OF THE INVENTION

1. Field of the Invention

Example embodiments generally relate to a fixing device and an image forming apparatus incorporating the fixing device, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such image forming apparatuses may include an on-demand fixing device, which is heated up to a proper fixing temperature within a shorter time after the fixing device is turned on. The on-demand fixing device may include a fixing film, a pressing roller, a heating plate, an infrared heater, and a reflection plate. The heating plate provided inside a loop formed by the fixing film is pressed against the pressing roller via the fixing film to form a nip between the fixing film and the pressing roller. The heating plate is heated by the infrared heater provided inside the loop formed by the fixing film, and heats the fixing film at the nip. As a recording medium bearing a toner image passes through the nip, the fixing film and the pressing roller apply heat and pressure to the recording medium to fix the toner image on the recording medium.

As a structure to cause the infrared heater to heat the fixing film more effectively, the reflection plate covers a part of an outer circumferential surface of the infrared heater in a circumferential direction of the infrared heater along an axial direction of the infrared heater that is substantially perpendicular to the circumferential direction of the infrared heater. Thus, the reflection plate reflects light emitted by the infrared heater toward the heating plate. In other words, the fixing film is heated via the heating plate both by light emitted by the infrared heater and irradiating the heating plate directly and by light reflected by the reflection plate toward the heating plate.

The image forming apparatus forms a toner image on various sizes of recording media. Accordingly, in the fixing device, the fixing film and the heating plate have a width, in an axial direction of the fixing film perpendicular to a recording medium conveyance direction, which corresponds to a width of a maximum-size of recording medium that the image forming apparatus can accommodate. When the fixing device is turned on, the fixing film is heated along the whole width thereof.

With this structure of the fixing device, however, after small-size recording media pass through the fixing device continuously, heat is drawn from a center portion of the fixing film in the axial direction of the fixing film over which the small-size recording media pass and is thus cooled by successive passages of the small-size recording media. By contrast, both end portions of the fixing film in the axial direction of the fixing film, over which the small-size recording media do not extend and therefore do not pass, are heated up to an excessively high temperature because there is nothing to draw heat therefrom. Consequently, when a large-size recording medium passes through the fixing device, a toner image on the large-size recording medium is heated excessively at both end portions of the fixing film in the axial direction of the fixing film, generating hot offset.

To address this problem, the fixing device may include a plurality of infrared heaters corresponding to various sizes of recording media. For example, the fixing device may include a first infrared heater for heating the center portion of the fixing film in the axial direction of the fixing film and a second infrared heater for heating both end portions of the fixing film in the axial direction of the fixing film. However, with such an arrangement, disposition of the reflection plates corresponding to the plurality of infrared heaters may be complicated, resulting in degraded heating efficiency for heating the fixing film, an enlarged fixing device, or increased manufacturing costs of the fixing device.

SUMMARY

At least one embodiment may provide a fixing device that includes a fixing member, an infrared heater, a first reflection plate, and at least one second reflection plate. The fixing member heats and melts a toner image on a recording medium, and forms a loop. The infrared heater opposes the fixing member to emit light to heat the fixing member. The first reflection plate covers a part of an outer circumferential surface of the infrared heater in a circumferential direction of the infrared heater along an axial direction of the infrared heater substantially perpendicular to the circumferential direction of the infrared heater. The first reflection plate reflects the light emitted by the infrared heater toward the fixing member, and includes at least one light control mirror provided in at least one end of the first reflection plate in an axial direction of the first reflection plate. The at least one second reflection plate opposes the infrared heater via the at least one light control mirror to reflect the light emitted by the infrared heater and passing through the at least one light control mirror toward a center portion of the fixing member in an axial direction of the fixing member.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
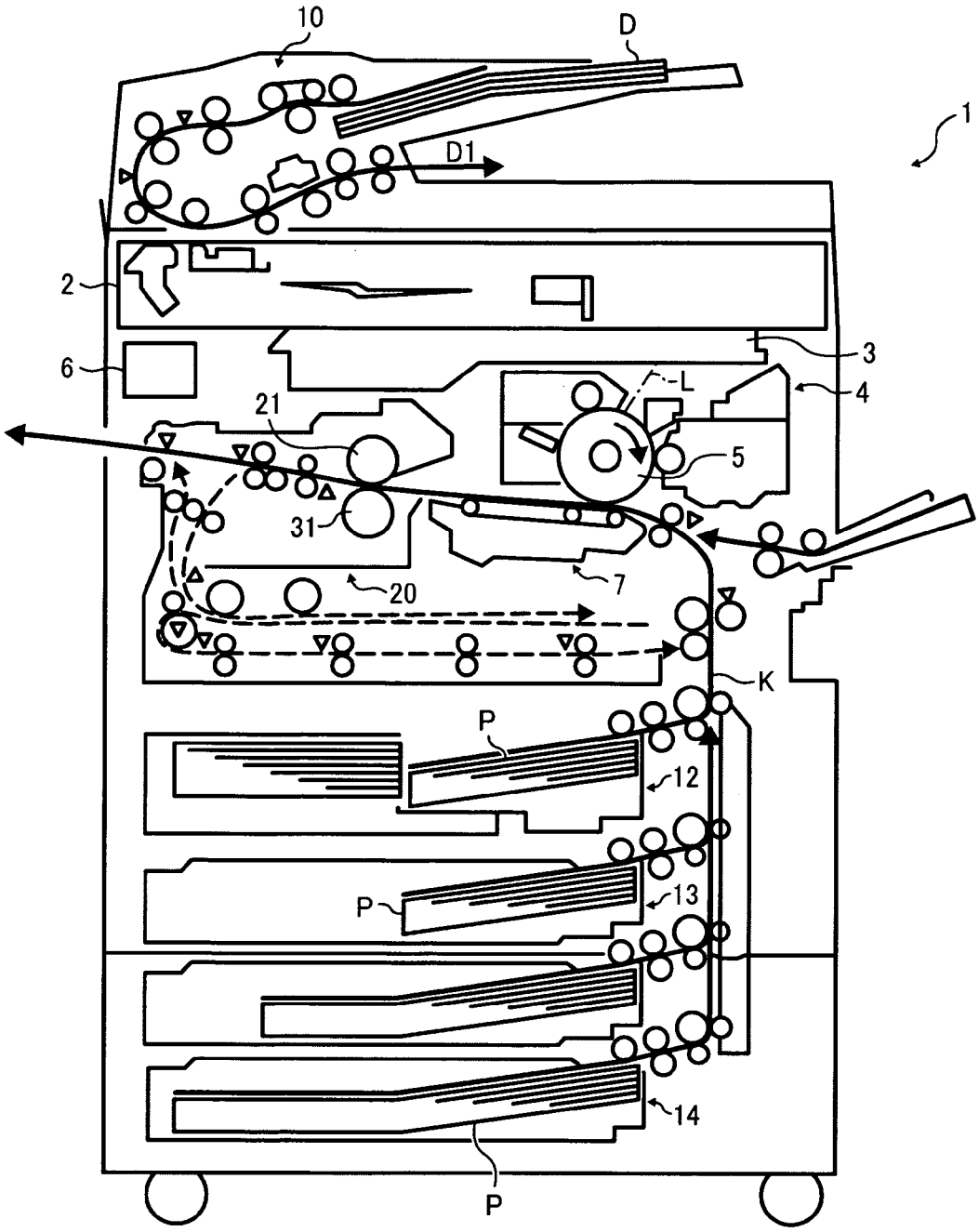
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be teemed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic view of the image forming apparatus 1. As illustrated in FIG. 1, the image forming apparatus 1 includes a reader 2, an exposure device 3, an image forming device 4, a transfer device 7, a document feeder 10, paper trays 12, 13, and 14, a fixing device 20, and/or a conveyance path K.

The image forming device 4 includes a photoconductive drum 5.

The fixing device 20 includes a controller 6, a fixing film 21, and/or a pressing roller 31.

As illustrated in FIG. 1, the image forming apparatus 1 may be a copier, a facsimile machine, a printer, a multifunction printer having at least one of copying, printing, scanning, plotter, and facsimile functions, or the like. According to this example embodiment of the present invention, the image forming apparatus 1 functions as a copier for forming an image on a recording medium by electrophotography.

The document feeder 10 loads a plurality of original documents D and feeds the original documents D one by one to the reader 2. The reader 2 optically reads an image on an original document D to generate image data. The exposure device 3 emits light L onto the photoconductive drum 5 of the image forming device 4 according to the image data generated by the reader 2 to form an electrostatic latent image on the photoconductive drum 5. The image forming device 4 forms the electrostatic latent image into a toner image. The transfer device 7 transfers the toner image formed on the photoconductive drum 5 onto a recording medium P (e.g., a transfer sheet) sent from one of the paper trays 12 to 14. The fixing device 20 fixes the toner image on the recording medium P. The fixing film 21 serves as a fixing member provided in the fixing device 20. The pressing roller 31 serves as a pressing member provided in the fixing device 20.

Referring to FIG. 1, the following describes image forming operations of the image forming apparatus 1.

In the document feeder 10, feeding rollers feed an original document D of a plurality of original documents D placed on an original document tray in a direction D1 toward the reader 2. When the original document D is conveyed above the reader 2, the reader 2 optically reads an image on the original document D passing above the reader 2 to generate image data.

After the reader 2 converts the image data into an electric signal, the reader 2 sends the electric signal to the exposure device 3 (e.g., a writer). The exposure device 3 emits light L (e.g., a laser beam) onto the photoconductive drum 5 of the image forming device 4 according to the electric signal to form an electrostatic latent image on the photoconductive drum 5.

In the image forming device 4, the photoconductive drum 5 rotates clockwise in FIG. 1. The image forming device 4 forms the electrostatic latent image formed on the photoconductive drum 5 into a toner image through image forming processes including a charging process, an exposing process, and a development process.

Each of the plurality of paper trays 12 to 14 loads a plurality of recording media P. One of the plurality of paper trays 12 to 14 is selected automatically or manually. When the paper tray 12 provided at a position higher than the paper trays 13 and 14 is selected, for example, an uppermost recording medium P placed in the paper tray 12 is sent to the conveyance path K.

When the uppermost recording medium P passes through the conveyance path K and reaches a registration roller pair, the registration roller pair feeds the uppermost recording medium P toward the transfer device 7 at a proper time at which the toner image formed on the photoconductive drum 5 is transferred onto a proper position on the uppermost recording medium P. Accordingly, the transfer device 7 transfers the toner image formed on the photoconductive drum 5 onto the uppermost recording medium P sent from the registration roller pair.

The recording medium P bearing the toner image which has passed through the transfer device 7 is conveyed through a conveyance path toward the fixing device 20. When the recording medium P reaches the fixing device 20, the fixing film 21 and the pressing roller 31 nip the recording medium P, and apply heat and pressure to the recording medium P to fix the toner image on the recording medium P. For example, the recording medium P receives heat from the fixing film 21 and pressure from the fixing film 21 and the pressing roller 31. Thereafter, the recording medium P bearing the fixed toner image is sent out of a nip formed between the fixing film 21 and the pressing roller 31, and is discharged from the image forming apparatus 1. Thus, a series of image forming processes is finished.

Referring to FIGS. 2 to 7, and 8A and 8B, the following describes a structure and operations of the fixing device 20 provided in the image forming apparatus 1 depicted in FIG. 1.

Figure 2:
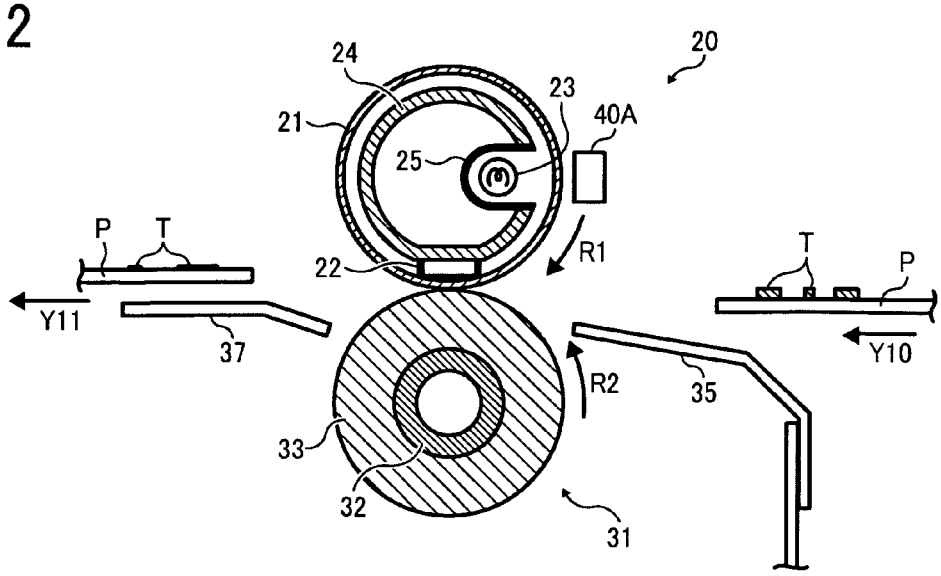
FIG. 2 is a sectional view (according to an example embodiment) of a center portion of a fixing device included in the image forming apparatus shown in FIG. 1 in a width direction of the fixing device.

FIG. 2 is a sectional view of a center portion of the fixing device 20 in a width direction, that is, an axial direction, of the fixing device 20. As illustrated in FIG. 2, the fixing device 20 further includes a pressing plate 22, an infrared heater 23, a holding member 24, a first reflection plate 25, guide plates 35 and 37, and/or a first temperature sensor 40A.

The pressing roller 31 includes a core metal 32 and/or an elastic layer 33.

Figure 3:
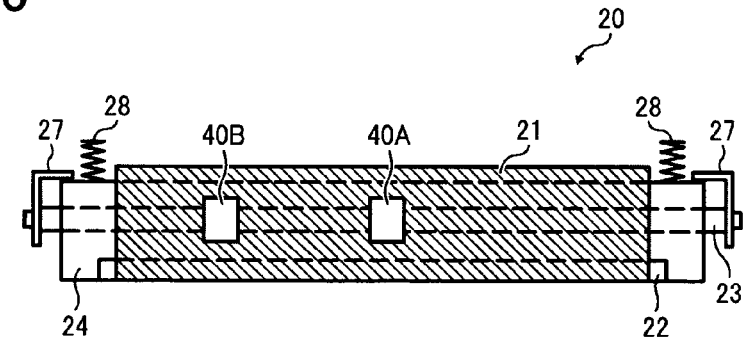
FIG. 3 is a partially axial view (according to an example embodiment) of the fixing device shown in FIG. 2 seen in the width direction of the fixing device.

FIG. 3 is a partially axial view of the fixing device 20 seen in the width direction of the fixing device 20. As illustrated in FIG. 3, the fixing device 20 further includes holders 27, springs 28, and/or a second temperature sensor 40B.

Figure 4:
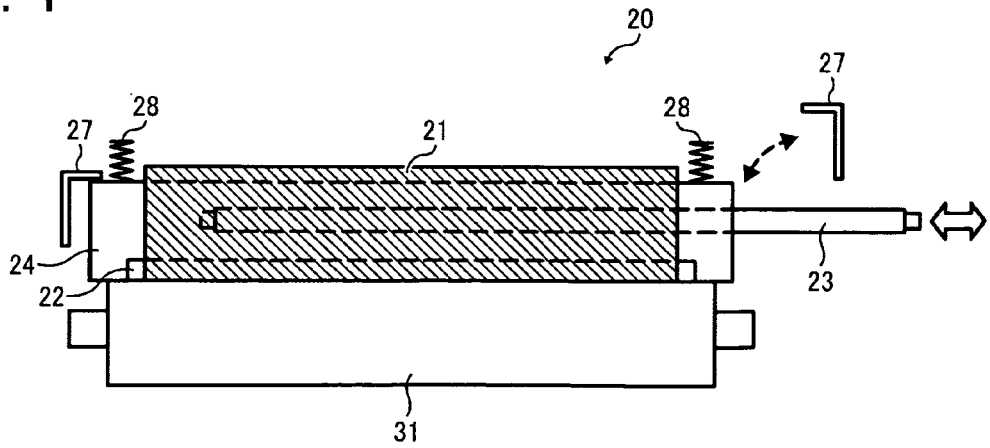
FIG. 4 is an axial view (according to an example embodiment) of the fixing device shown in FIG. 2 seen in the width direction of the fixing device when an infrared heater included in the fixing device is attached to and detached from the fixing device.

FIG. 4 is an axial view of the fixing device 20 seen in the width direction of the fixing device 20 when the infrared heater 23 is attached to and detached from the fixing device 20.

Figure 5:
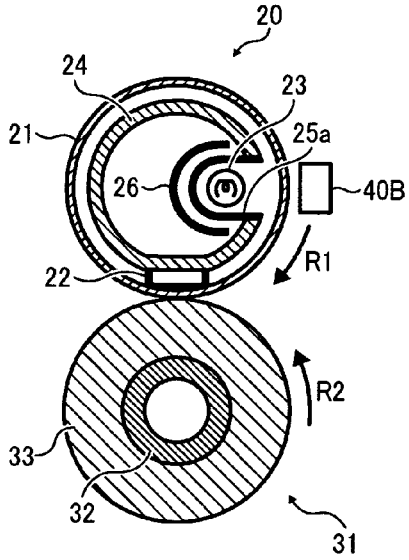
FIG. 5 is a sectional view (according to an example embodiment) of one end of the fixing device shown in FIG. 2 in the width direction of the fixing device.

FIG. 5 is a sectional view of one end of the fixing device 20 in the width direction of the fixing device 20. As illustrated in FIG. 5, the fixing device 20 further includes a light control mirror 25*a* and/or a second reflection plate 26.

Figure 6:
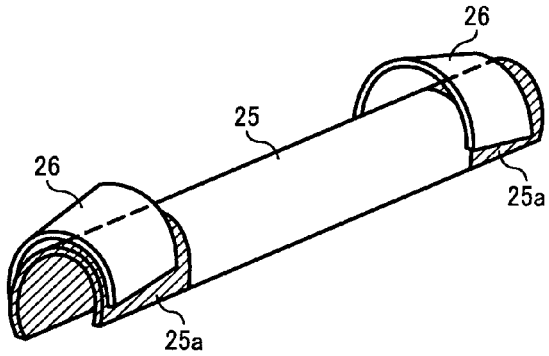
FIG. 6 is a perspective view (according to an example embodiment) of a first reflection plate and a second reflection plate included the fixing device shown in FIG. 5.

FIG. 6 is a perspective view of the first reflection plate 25 and the second reflection plates 26.

Figure 7:
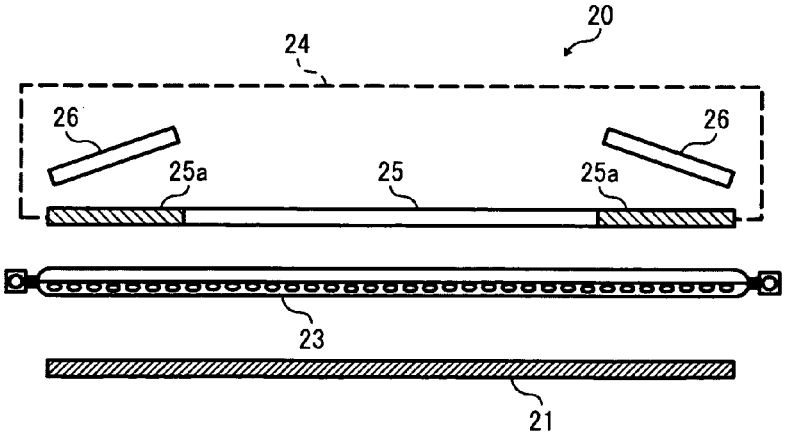
FIG. 7 is a schematic sectional view (according to an example embodiment) of the first reflection plate shown in FIG. 6, the second reflection plate shown in FIG. 6, the infrared heater shown in FIG. 4, and a fixing film included in the fixing device shown in FIG. 2 seen in the width direction of the fixing device.

FIG. 7 is a schematic sectional view of the first reflection plate 25, the second reflection plates 26, the infrared heater 23, and the fixing film 21 seen in the width direction of the fixing device 20.

Figure 8A:
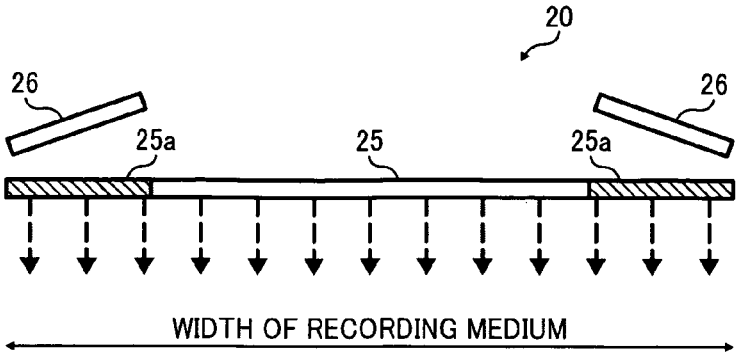
FIG. 8A is a sectional view (according to an example embodiment) of the first reflection plate and the second reflection plate shown in FIG. 6 in the width direction of the fixing device shown in FIG. 2 when a large-size recording medium passes through the fixing device.

FIG. 8A is a sectional view of the first reflection plate 25 and the second reflection plates 26 in the width direction of the fixing device 20 when a large-size recording medium P passes through the fixing device 20.

Figure 8B:
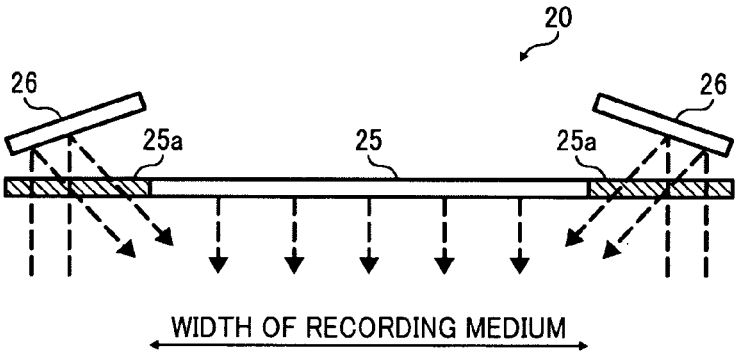
FIG. 8B is a sectional view (according to an example embodiment) of the first reflection plate and the second reflection plate shown in FIG. 6 in the width direction of the fixing device shown in FIG. 2 when a small-size recording medium passes through the fixing device.

FIG. 8B is a sectional view of the first reflection plate 25 and the second reflection plates 26 in the width direction of the fixing device 20 when a small-size recording medium P passes through the fixing device 20.

FIG. 2 is a sectional view of the center portion of the fixing device 20 in the width direction of the fixing device 20 in which the second reflection plates 26 depicted in FIG. 6 are not provided. FIG. 5 is a sectional view of one end of the fixing device 20 in the width direction of the fixing device 20 in which the second reflection plate 26 is provided. As illustrated in FIGS. 2 and 5, in the fixing device 20, the fixing film 21 serves as a fixing member. The pressing plate 22 serves as a contact member. The first reflection plate 25 serves as a first reflection member. The second reflection plate 26 serves as a second reflection member. The pressing roller 31 serves as a pressing member. The first temperature sensor 40A (e.g., a thermopile) serves as a first temperature detector. The second temperature sensor 40B (e.g., a thermopile) serves as a second temperature detector.

The fixing film 21 serving as a fixing member may be a thin, flexible endless film, and rotates clockwise in FIG. 2 in a rotation direction R1. The fixing film 21 may include polyimide, polyamide, fluorocarbon resin, metal, and/or the like. In order to provide releasing property (e.g., separation property) for releasing or separating the fixing film 21 from a toner image T, the fixing film 21 may include a releasing layer including PFA (ethylene tetrafluoride perfluoroalkylvinylether copolymer resin), polyimide, polyetherimide, PES (polyether sulfide), and/or the like as a surface layer. The fixing device 20 uses the fixing film 21 having a low thermal capacity as a fixing member, thus serving as an on-demand fixing device providing a shorter warm-up time.

The infrared heater 23 serving as a heater, the pressing plate 22, the first reflection plate 25, the second reflection plate 26, and the holding member 24 are fixedly provided inside a loop formed by the fixing film 21 in such a manner that the infrared heater 23, the pressing plate 22, the first reflection plate 25, the second reflection plate 26, and the holding member 24 face an inner circumferential surface of the fixing film 21. The pressing plate 22 held by the holding member 24 presses the fixing film 21 against the pressing roller 31 to form the nip between the fixing film 21 and the pressing roller 31.

The pressing plate 22 serving as a contact member may be a metal plate or a plate member including ceramic and/or polyimide resin. The pressing plate 22 is held by the holding member 24 and is pressed against the pressing roller 31 via the fixing film 21 to form the desired nip between the fixing film 21 and the pressing roller 31.

According to this example embodiment, the pressing plate 22 includes a planar opposing surface portion which opposes the pressing roller 31. Accordingly, the nip formed between the fixing film 21 and the pressing roller 31 is substantially parallel to the toner image T on the recording medium P. Namely, the fixing film 21 contacts the recording medium P properly, improving fixing property. Further, when the recording medium P passes through the nip, the recording medium P may not be curled or creased. A great curvature of the fixing film 21 at an exit of the nip in a recording medium conveyance direction separates the recording medium P sent out of the nip from the fixing film 21 easily.

According to this example embodiment, a sliding surface of the pressing plate 22 over which the fixing film 21 slides is coated with fluorocarbon resin, reducing wear of the inner circumferential surface of the fixing film 21 sliding over the pressing plate 22 fixedly provided in the fixing device 20.

The infrared heater 23 may be a carbon heater or a halogen heater. Both ends of the infrared heater 23 in a width direction, that is, an axial direction, of the infrared heater 23 corresponding to the axial direction of the fixing film 21 are mounted on side plates of the fixing device 20 via the holding member 24. The infrared heater 23 controlled by a power source of the image forming apparatus 1 (depicted in FIG. 1) heats the fixing film 21, and heat is transmitted from an outer circumferential surface of the fixing film 21 to the toner image T on the recording medium P. Output of the infrared heater 23 is controlled based on a detection result provided by the first temperature sensor 40A facing the outer circumferential surface of the fixing film 21 and detecting temperature of the outer circumferential surface of the fixing film 21. By controlling output of the infrared heater 23, the temperature (e.g., a fixing temperature) of the fixing film 21 can be set to a desired temperature.

As illustrated in FIGS. 3 and 5, according to this example embodiment, in addition to the first temperature sensor 40A serving as a first temperature detector provided at a position facing a center portion of the fixing film 21 in a width direction, that is, the axial direction, of the fixing film 21 to control output of the infrared heater 23, the second temperature sensor 40B, serving as a second temperature detector, is provided at a position facing one end of the fixing film 21 in the width direction of the fixing film 21 to control transmittance of the light control mirror 25*a*.

The first reflection plate 25 faces a side of the infrared heater 23 opposite to a side of the infrared heater 23 opposing the fixing film 21. In other words, the first reflection plate 25 is provided on the left of the infrared heater 23 in FIG. 2. The first reflection plate 25 includes a base including glass and a reflecting surface portion provided on the base. For example, the base is overlaid with gold or evaporated with aluminum to form the reflecting surface portion which reflects infrared rays generated by the infrared heater 23. Most of the infrared rays (e.g., light) reflected by the first reflection plate 25 irradiate the fixing film 21 to increase heating efficiency for heating the fixing film 21.

As illustrated in FIG. 6, the light control mirrors 25*a* are provided in both ends of the first reflection plate 25 in a width direction, that is, an axial direction, of the first reflection plate 25 corresponding to the axial direction of the fixing film 21 depicted in FIG. 5. The second reflection plates 26 are provided at positions opposing the infrared heater 23 via the light control mirrors 25*a*, respectively.

In the fixing device 20 according to this example embodiment as illustrated in FIG. 5, the infrared heater 23, the first reflection plate 25, and the second reflection plates 26 are provided at a position facing the inner circumferential surface of the fixing film 21 and upstream from the nip in the rotation direction R1 of the fixing film 21. If the fixing film 21 is heated at the nip, the fixing temperature of the fixing film 21 increases as the fixing film 21 moves downstream through the nip. Accordingly, gloss of the toner image T may not increase. To address this, according to this example embodiment, the fixing film 21 is heated at the position upstream from the nip in the rotation direction R1 of the fixing film 21. Thus, as the fixing film 21 moves downstream through the nip, cooling efficiency for cooling the toner image T increases to improve gloss of the toner image T.

An absorption member for absorbing infrared rays may be provided on the inner circumferential surface of the fixing film 21 facing the infrared heater 23. For example, the inner circumferential surface of the fixing film 21 may be black-coated. Accordingly, the fixing film 21 may absorb infrared rays efficiently, improving heating efficiency for heating the fixing film 21.

As illustrated in FIGS. 2, 3, and 5, the holding member 24 integrally holds the pressing plate 22, the infrared heater 23, the first reflection plate 25, and the second reflection plates 26, and includes heat-resistant resin. Both ends of the holding member 24 in a width direction, that is, an axial direction, of the holding member 24 corresponding to the axial direction of the fixing film 21 are mounted on the side plates of the fixing device 20, respectively.

As illustrated in FIG. 3, the holding member 24 holds the infrared heater 23 via the holders 27. For example, screws secure the holders 27 to both ends of the holding member 24 in the width direction of the holding member 24, respectively. Through-holes provided in the holders 27 engage both ends of the infrared heater 23 in the width direction of the infrared heater 23, respectively. As illustrated in FIG. 4, one of the holders 27 is detached from the holding member 24 to detach the infrared heater 23 from the holding member 24 and the fixing device 20.

The springs 28 (e.g., compression springs) are provided at both ends of the holding member 24 in the width direction of the holding member 24, respectively. The springs 28 press the pressing plate 22 against the pressing roller 31 to form the desired nip between the fixing film 21 and the pressing roller 31. Both ends of the pressing roller 31 in an axial direction of the pressing roller 31 are rotatably mounted at fixed positions on the side plates of the fixing device 20 via bearings, respectively. A driving motor drives and rotates the pressing roller 31 in a given direction. Friction between the fixing film 21 and the pressing roller 31 rotates the fixing film 21 in the rotation direction R1 in FIG. 2. With the above-described structure, a driving mechanism and a pressing mechanism of the fixing device 20 are simplified.

As illustrated in FIG. 2, the holding member 24 guides the fixing film 21. For example, the holding member 24 has a circular shape to maintain a circular shape of the flexible fixing film 21. Thus, the holding member 24 reduces wear and damage of the fixing film 21 due to deformation of the fixing film 21.

The pressing roller 31 serving as a pressing member includes the core metal 32 and the elastic layer 33 provided on the core metal 32. The elastic layer 33 includes fluorocarbon rubber, silicon rubber, and/or silicon rubber foam. A thin releasing layer (e.g., a tube) including PFA may be provided on the elastic layer 33 as a surface layer. The pressing roller 31 is pressed against the fixing film 21 to form the desired nip between the fixing film 21 and the pressing roller 31. A driving mechanism rotates the pressing roller 31 counterclockwise in FIG. 2 in a rotation direction R2.

The guide 35 serving as an entrance guide plate is provided at an entrance to the nip, that is, a contact portion at which the fixing film 21 contacts the pressing roller 31, and guides a recording medium P toward the nip. The guide 37 serving as an exit guide plate is provided at an exit of the nip, and guides the recording medium P sent out of the nip. The guides 35 and 37 are fixedly provided on a frame or a casing of the fixing device 20.

Referring to FIGS. 1 and 2, the following describes operations of the fixing device 20 having the above-described structure.

When the image forming apparatus 1 is powered on, power is supplied to the infrared heater 23, and the pressing roller 31 starts rotating in the rotation direction R2. The rotating pressing roller 31 rotates the fixing film 21 in the rotation direction R1 due to friction between the fixing film 21 and the pressing roller 31. In other words, the fixing film 21 is driven by the pressing roller 31.

Thereafter, a toner image T formed by the image forming device 4 is transferred onto a recording medium P sent from the paper tray 12, 13, or 14. The recording medium P bearing the toner image T is sent to the fixing device 20. Specifically, the guide 35 guides the recording medium P in a direction Y10 to the nip formed between the fixing film 21 and the pressing roller 31 pressed against each other. The fixing film 21 heated by the infrared heater 23 at a position upstream from the nip in the rotation direction R1 of the fixing film 21 applies heat to the recording medium P. The pressing plate 22 applies pressure to the recording medium P via the fixing film 21. Simultaneously, the pressing roller 31 applies pressure to the recording medium P. Thus, the heat applied by the fixing film 21 and the pressure applied by the pressing plate 22 and the pressing roller 31 fix the toner image T on the recording medium P. Thereafter, the recording medium P is sent out of the nip and conveyed in a direction Y11.

Referring to FIGS. 6, 7, 8A, and 8B, the following describes the structure and the operations of the fixing device 20 in detail.

As illustrated in FIG. 6, the first reflection plate 25 has a semi-cylindrical shape, and covers a part of an outer circumferential surface of the infrared heater 23 in a circumferential direction of the infrared heater 23, which does not face the inner circumferential surface of the fixing film 21, along the width direction of the infrared heater 23, that is, along the axial direction of the infrared heater 23. The first reflection plate 25 reflects light (e.g., infrared rays) emitted by the infrared heater 23 to cause the reflected light to irradiate the fixing film 21.

In a center portion of the first reflection plate 25 in the width direction of the first reflection plate 25, that is, a portion other than both ends of the first reflection plate 25 in the width direction of the first reflection plate 25, the base including glass is overlaid with gold or evaporated with aluminum to form the reflecting surface portion on the base.

On the other hand, the light control mirrors 25*a* are provided in both ends of the first reflection plate 25 in the width direction of the first reflection plate 25. For example, a light control glass film is attached to the base including glass of the first reflection plate 25 at both ends of the first reflection plate 25 in the width direction of the first reflection plate 25. Thus, the light control mirrors 25*a* are provided in the first reflection plate 25. The light control mirrors 25*a* are hardwired so that a voltage of plus or minus 5 V is applied to the light control mirrors 25*a*. The voltage input to the light control mirrors 25*a* is changed to adjust the transmittance of the light control mirrors 25*a* for transmitting infrared rays.

The light control mirror 25*a* may be switchable between a mirror state and a transparent state electrically, and may be a film having a thickness of about 100 μm. For example, the light control mirror 25*a* may be switchable in two methods, which are an electrochromic method in which the light control mirror 25*a* is switched electrically and a gasochromic method in which the light control mirror 25*a* is switched by being exposed to gas containing dilute hydrogen.

The light control mirror 25*a* may be an all-solid-state member not including a gas layer such as a hydrogen gas layer and a liquid layer. The light control mirror 25*a* may include a flexible base and a thin alloy film provided on the base. The base may include glass (e.g., a glass plate) and/or plastic. The thin alloy film may include indium-tin oxide (ITO), tungsten oxide ($WO_3$), tantalum oxide ($Ta_2O_5$), aluminum (Al), palladium (Pd), and/or magnesium nickel (Mg.Ni). Each of the base and the thin alloy film may function as a transparent conductive film, an ion storage layer, a solid electrolyte layer, a buffer layer, a catalyst layer, and/or a light control mirror layer. The thin film materials may be prepared in a room temperature process with a magnetron spatter device.

The all-solid-state light control mirror 25*a* prepared by using the magnesium nickel thin alloy film as a light control mirror layer is in the mirror state initially. When the voltage of about plus or minus 5 V is applied, hydrogen ion ($H^+$) stored in the ion storage layer ($H_xWO_3$) moves to the light control mirror layer (e.g., magnesium nickel alloy in a metallic state), and the magnesium nickel alloy in the metallic state is hydrogenated into a nonmetallic state in which the all-solid-state light control mirror 25*a* is in the transparent state. This change of state occurs in about 15 seconds. When a reversed voltage of about minus 5 V is applied, hydrogen ion returns into the ion storage layer ($WO_3$), and the light control mirror layer returns to the original mirror state (e.g., the metallic state). This change of state occurs in about 10 seconds. Once the change of state occurs, the state is maintained even when the light control mirror 25*a* is powered off.

As illustrated in FIG. 7, the second reflection plates 26 are provided at positions at which the second reflection plates 26 oppose the infrared heater 23 via the light control mirrors 25*a*, respectively. In other words, a pair of second reflection plates 26 is arranged at both ends of the first reflection plate 25 in the width direction of the first reflection plate 25 over an outer circumferential surface of the first reflection plate 25 opposite to an inner circumferential surface of the first reflection plate 25 facing the infrared heater 23. The second reflection plate 26 includes a reflecting surface portion mirror-finished with aluminum, which reflects light (e.g., infrared rays) emitted by the infrared heater 23 and passing through the light control mirror 25*a* toward the center portion of the fixing film 21 in the width direction of the fixing film 21. In other words, the reflecting surface portion of the second reflection plate 26 is not parallel to the width direction of the first reflection plate 25 but is tilted with respect to the width direction of the first reflection plate 25. Namely, the pair of second reflection plates 26 is tilted in symmetric with respect to the center portion of the first reflection plate 25 in the width direction of the first reflection plate 25.

The transmittance of the light control mirror 25*a* changes depending on size of a recording medium P in a width direction of the recording medium P passing through the fixing device 20.

For example, when a recording medium P having a maximum-size handled by the fixing device 20 (e.g., an A3-size recording medium P) passes through the fixing device 20 as illustrated in FIG. 8A, a width of the recording medium P corresponds to a whole width of the fixing film 21 or the infrared heater 23 in the width direction of the fixing film 21 or the infrared heater 23. Accordingly, a voltage of minus 5 V is applied to the light control mirrors 25*a* to decrease the transmittance of the light control mirrors 25*a* to zero percent so that the light control mirrors 25*a* are in the mirror state. Thus, a whole width of the first reflection plate 25 and the light control mirrors 25*a* reflects infrared rays. Consequently, the whole width of the fixing film 21 is substantially uniformly irradiated both by light generated by the infrared heater 23 to directly irradiate the fixing film 21 and by light reflected by the first reflection plate 25 illustrated by broken-line arrows in FIG. 8A. As a result, the whole width of the fixing film 21 is heated uniformly, and therefore a toner image T is fixed properly on the maximum-size recording medium P in a whole width of the maximum-size recording medium P.

By contrast, when a small-size recording medium P (e.g., an A4-size recording medium P) passes through the fixing device 20 as illustrated in FIG. 8B, a width of the small-size recording medium P corresponds to the center portion of the fixing film 21 or the infrared heater 23 in the width direction of the fixing film 21 or the infrared heater 23. Accordingly, a voltage of plus 5 V is applied to the light control mirrors 25*a* to increase the transmittance of the light control mirrors 25*a* so that the light control mirrors 25*a* are in the transparent state. Thus, at both ends of the first reflection plate 25 in the width direction of the first reflection plate 25 over which the recording medium P does not pass, light emitted by the infrared heater 23 and reaching the light control mirrors 25*a* passes through the light control mirrors 25*a*, and is reflected by the second reflection plates 26. Thereafter, the light passes through the light control mirrors 25*a* again and irradiates the center portion of the fixing film 21 in the width direction of the fixing film 21. On the other hand, at the center portion of the first reflection plate 25 in the width direction of the first reflection plate 25 over which the recording medium P passes, light emitted by the infrared heater 23 and reaching the first reflection plate 25 is reflected by the reflecting surface portion of the first reflection plate 25, and irradiates the center portion of the fixing film 21 in the width direction of the fixing film 21. Namely, the light reflected by the first reflection plate 25 does not irradiate both ends of the fixing film 21 in the width direction of the fixing film 21, suppressing excessive temperature increase at both ends of the fixing film 21 in the width direction of the fixing film 21. By contrast, the center portion of the fixing film 21 in the width direction of the fixing film 21 is irradiated by the light emitted by the infrared heater 23 and irradiating the fixing film 21 directly, the light reflected by the first reflection plate 25, and the light reflected by the second reflection plates 26 illustrated in broken-line arrows in FIG. 8B. Accordingly, the center portion of the fixing film 21 in the width direction of the fixing film 21 is heated effectively. Consequently, a toner image T is fixed on the small-size recording medium P properly in a whole width of the small-size recording medium P.

Even when small-size recording media P pass through the fixing device 20 continuously, excessive temperature increase at both ends of the fixing film 21 in the width direction of the fixing film 21 is suppressed. Further, even when a large-size recording medium P passes through the fixing device 20 immediately after the small-size recording media P pass through the fixing device 20, hot offset is suppressed. Moreover, when a small-size recording medium P passes through the fixing device 20, the second reflection plates 26 reflect the light emitted from both ends of the infrared heater 23 in the width direction of the infrared heater 23, over which the small-size recording medium P does not pass, to use the reflected light to heat the center portion of the fixing film 21 in the width direction of the fixing film 21 over which the small-size recording medium P passes. Thus, heat generated by the infrared heater 23 is utilized effectively.

According to this example embodiment, the controller 6 (depicted in FIG. 1) may control the transmittance of the light control mirrors 25*a* (depicted in FIG. 7) based on a detection result provided by the second temperature sensor 40B (depicted in FIG. 3) serving as a second temperature detector for detecting temperature of one end of the fixing film 21 (depicted in FIG. 7) in the axial direction of the fixing film 21.

Figure 9:
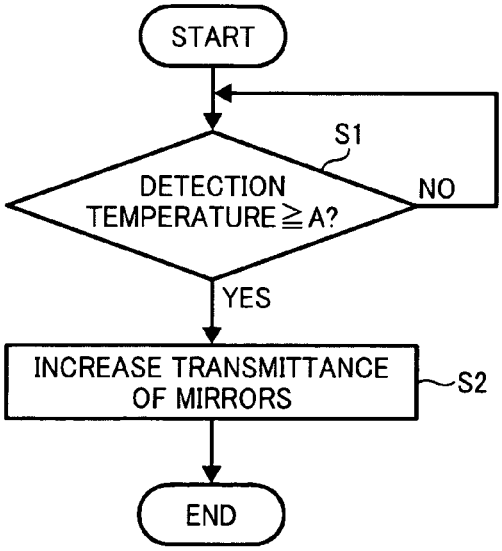
FIG. 9 is a flowchart (according to an example embodiment) illustrating control processes for controlling light control mirrors included in the first reflection plate shown in FIG. 6.

FIG. 9 is a flowchart illustrating control processes for controlling the light control mirrors 25*a*. In step S1, the controller 6 judges whether or not a detection temperature detected by the second temperature sensor 40B equals to a reference temperature A or higher. When the detection temperature equals to the reference temperature A or higher (e.g., if YES is selected in step S1), the controller 6 increases the transmittance of the light control mirrors 25*a* to switch the state of the light control mirrors 25*a* to the transparent state in step S2. For example, when the second temperature sensor 40B detects excessive temperature increase in one end of the fixing film 21 in the width direction, that is, the axial direction, of the fixing film 21, the controller 6 controls the light control mirrors 25*a* of the first reflection plate 25 to be in the transparent state illustrated in FIG. 8B. The reference temperature A corresponds to a temperature of the outer circumferential surface of the fixing film 21 at which hot offset starts generating.

The above-described control suppresses excessive temperature increase of both ends of the fixing film 21 in the width direction of the fixing film 21 precisely regardless of size of a recording medium P passing through the fixing device 20, preventing hot offset.

FIG. 9 illustrates the control for changing the transmittance of the light control mirrors 25*a* based on the detection result provided by the second temperature sensor 40B. Alternatively, the controller 6 may control the transmittance of the light control mirrors 25*a* based on a detection result provided by the first temperature sensor 40A and the second temperature sensor 40B depicted in FIG. 3. For example, when a difference between a detection temperature provided by the first temperature sensor 40A and a detection temperature provided by the second temperature sensor 40B is not smaller than a reference value, the controller 6 judges that temperature of both ends of the fixing film 21 in the axial direction of the fixing film 21 is increased excessively, and increases the transmittance of the light control mirrors 25*a* to switch the state of the light control mirrors 25*a* to the transparent state, so as to provide effects equivalent to the effects of the above-described control using the second temperature sensor 40B.

Figure 10A:
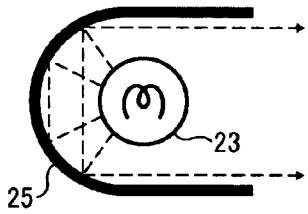
FIG. 10A is a sectional view (according to an example embodiment) of the infrared heater shown in FIG. 4 and one example of the first reflection plate shown in FIG. 6.
Figure 10B:
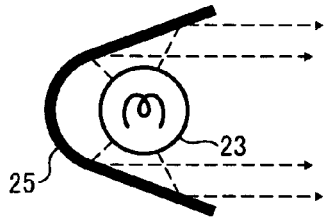
FIG. 10B is a sectional view (according to an example embodiment) of the infrared heater shown in FIG. 4 and another example of the first reflection plate shown in FIG. 6.

FIGS. 10A, 10B, 10C, and 10D illustrate a sectional view of the infrared heater 23 and the first reflection plate 25 showing variations of shape of the first reflection plate 25. According to this example embodiment, the first reflection plate 25 is substantially arc-shaped in cross-section as illustrated in FIG. 10A. The infrared heater 23 is disposed at a focus position at which light reflected by the first reflection plate 25 is focused to increase reflection efficiency of the first reflection plate 25, that is, a degree at which light generated by the infrared heater 23 and reflected by the first reflection plate 25 irradiates the fixing film 21 depicted in FIG. 2 effectively through an optical path shown by broken-line arrows in FIG. 10A.

Figure 10C:
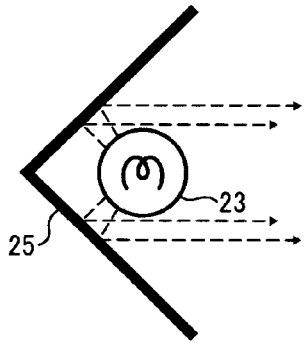
FIG. 10C is a sectional view (according to an example embodiment) of the infrared heater shown in FIG. 4 and yet another example of the first reflection plate shown in FIG. 6.
Figure 10D:
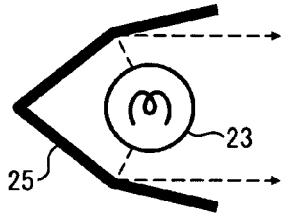
FIG. 10D is a sectional view (according to an example embodiment) of the infrared heater shown in FIG. 4 and yet another example of the first reflection plate shown in FIG. 6.

The cross-sectional shape of the first reflection plate 25 is not limited to the shape illustrated in FIG. 10A. For example, the first reflection plate 25 may have a shape illustrated in FIG. 10B, 10C, or 10D. Especially, when the infrared heater 23 provides light distribution, the first reflection plate 25 may have an intersection angle of 90 degrees as illustrated in FIG. 10C, and the infrared heater 23 may be disposed at a position at which a perpendicular line in a light distribution direction of the infrared heater 23 bisects the intersection angle of the first reflection plate 25. Thus, reflection light rays reflected by the first reflection plate 25 may be uniformized.

As illustrated in FIGS. 2 and 7, according to this example embodiment, the first reflection plate 25 covers a part of the outer circumferential surface of the infrared heater 23 in the circumferential direction of the infrared heater 23 along the width direction of the infrared heater 23 for heating the fixing film 21 serving as a fixing member. The light control mirrors 25*a* are provided in both ends of the first reflection plate 25 in the width direction of the first reflection plate 25, respectively. As illustrated in FIG. 8B, the second reflection plates 26 reflect light emitted by the infrared heater 23 and passing through the light control mirrors 25*a* toward the center portion of the fixing film 21 in the width direction of the fixing film 21. With this structure, the fixing device 20 is heated to a proper fixing temperature within a short time after the fixing device 20 is powered on. Further, the compact fixing device 20 having the relatively simple structure is manufactured at reduced costs. Even when small-size recording media P pass through the fixing device 20 continuously, both ends of the fixing film 21 in the width direction of the fixing film 21 are not heated up to an excessively high temperature. Thus, the fixing device 20 and the image foaming apparatus 1 (depicted in FIG. 1), including the fixing device 20 provide improved heating efficiency for heating the fixing film 21.

As illustrated in FIG. 2, in the fixing device 20 according to this example embodiment, the pressing roller 31 serves as a pressing member, and the fixing film 21 serves as a fixing member. Alternatively, a pressing belt or a pressing pad may serve as a pressing member, and a fixing belt or a fixing roller may serve as a fixing member.

Further, non-contact thermopiles are used as the first temperature sensor 40A and the second temperature sensor 40B, respectively. Alternatively, contact thermistors may be used as the first temperature sensor 40A and the second temperature sensor 40B, respectively, to provide effects equivalent to the effects provided by the fixing device 20.

Figure 11:
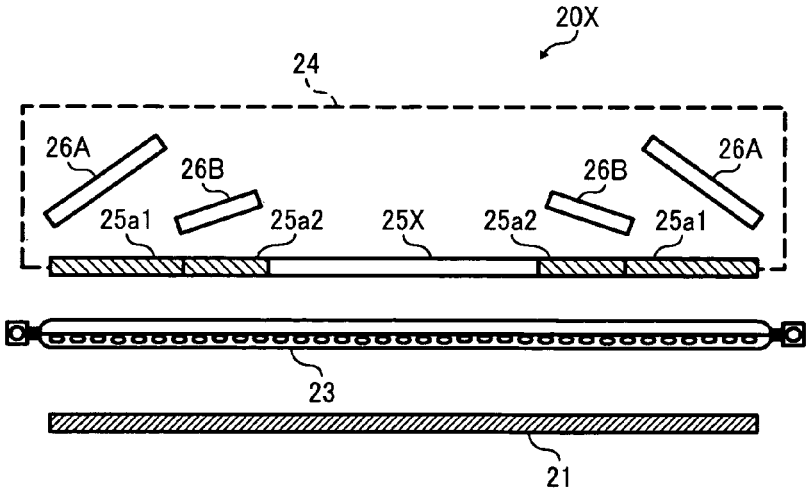
FIG. 11 is a partially sectional view of a fixing device according to another example embodiment seen in a width direction of the fixing device.
Figure 12A:
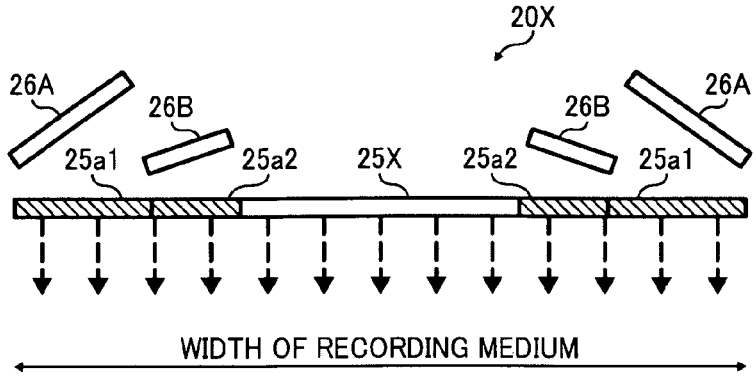
FIG. 12A is a sectional view (according to an example embodiment) of the fixing device shown in FIG. 11 when a large-size recording medium passes through the fixing device.
Figure 12B:
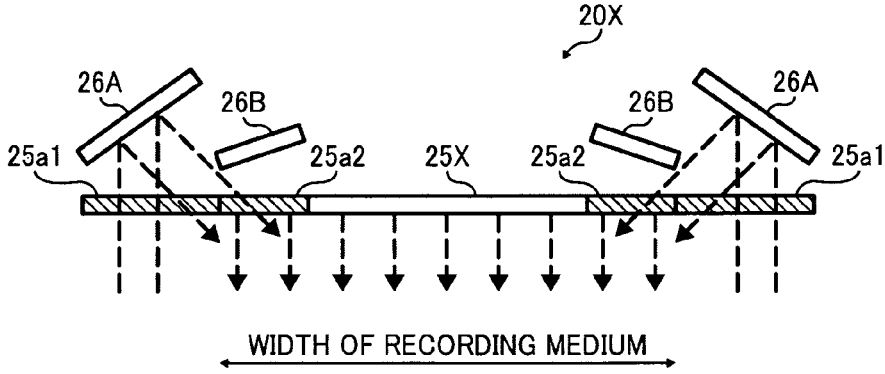
FIG. 12B is a sectional view (according to an example embodiment) of the fixing device shown in FIG. 11 when a medium-size recording medium passes through the fixing device.
Figure 12C:
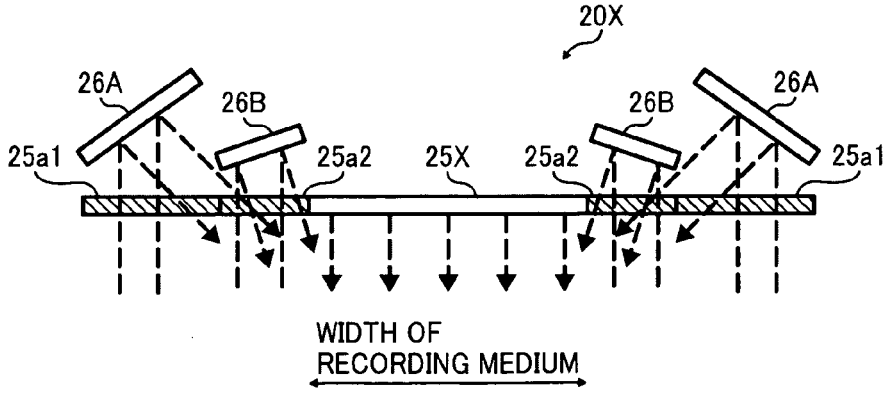
FIG. 12C is a sectional view (according to an example embodiment) of the fixing device shown in FIG. 11 when a small-size recording medium passes through the fixing device.

Referring to FIGS. 11, 12A, 12B, 12C, and 13, the following describes a fixing device 20X according to another example embodiment. FIG. 11 is a partially sectional view of the fixing device 20X seen in a width direction of the fixing device 20X. FIG. 12A is a sectional view of the fixing device 20X when a large-size recording medium P passes through the fixing device 20X. FIG. 12B is a sectional view of the fixing device 20X when a medium-size recording medium P passes through the fixing device 20X. FIG. 12C is a sectional view of the fixing device 20X when a small-size recording medium P passes through the fixing device 20X.

FIG. 11 illustrating the fixing device 20X corresponds to FIG. 7 illustrating the fixing device 20. FIGS. 12A, 12B, and 12C illustrating the fixing device 20X correspond to FIGS. 8A and 8B illustrating the fixing device 20.

As illustrated in FIG. 11, the fixing device 20X includes a first reflection plate 25X, outer second reflection plates 26A, and/or inner second reflection plates 26B. The first reflection plate 25X includes first light control mirrors 25*a*1 and/or second light control mirrors 25*a*2. The first reflection plate 25X replaces the first reflection plate 25 of the fixing device 20 depicted in FIG. 7. The outer second reflection plates 26A and the inner second reflection plates 26B replace the second reflection plates 26 of the fixing device 20. The other elements of the fixing device 20X are equivalent to the elements of the fixing device 20.

Unlike in the fixing device 20 depicted in FIG. 7, in the fixing device 20X, a plurality of pairs of light control mirrors, which are a pair of first light control mirrors 25*a*1 and a pair of second light control mirrors 25*a*2, are provided in both ends of the first reflection plate 25X in a width direction of the first reflection plate 25X, that is, an axial direction of the first reflection plate 25X corresponding to the axial direction of the fixing film 21, respectively. A plurality of pairs of second reflection plates, which are a pair of outer second reflection plates 26A and a pair of inner second reflection plates 26B, is provided at positions corresponding to the plurality of pairs of light control mirrors which are the pair of first light control mirrors 25*a*1 and the pair of second light control mirrors 25*a*2, respectively.

Like the fixing device 20 depicted in FIG. 2, the fixing device 20X further includes the fixing film 21 serving as a fixing member, the pressing plate 22 serving as a contact member, the infrared heater 23, the holding member 24, the pressing roller 31 serving as a pressing member, the first temperature sensor 40A serving as a first temperature detector, and the second temperature sensor 40B serving as a second temperature detector. Like the first reflection plate 25 of the fixing device 20, the first reflection plate 25X serves as a first reflection member. The outer second reflection plates 26A and the inner second reflection plates 26B serve as a second reflection member.

The first light control mirror 25*a*1 is provided adjacent to the second light control mirror 25*a*2 at each of both ends of the first reflection plate 25X in the width direction of the first reflection plate 25X. In other words, the pair of first light control mirrors 25*a*1 is provided outboard of the pair of second light control mirrors 25*a*2 in the width direction of the first reflection plate 25X. The pair of second light control mirrors 25*a*2 is provided inboard of the pair of first light control mirrors 25*a*1, and is adjacent to the pair of first light control mirrors 25*a*1. The first light control mirrors 25*a*1 and the second light control mirrors 25*a*2 are hardwired in such a manner that a voltage of the first light control mirrors 25*a*1 is controlled separately from a voltage of the second light control mirrors 25*a*2 for transmittance control.

The two pairs of second reflection plates, which are the pair of outer second reflection plates 26A and the pair of inner second reflection plates 26B, are provided at positions opposing the two pairs of light control mirrors, which are the pair of first light control mirrors 25*a*1 and the pair of second light control mirrors 25*a*2, respectively. In other words, the pair of outer second reflection plates 26A, which corresponds to the pair of first light control mirrors 25*a*1, is provided outboard of the pair of inner second reflection plates 26B in the width direction of the first reflection plate 25X. The pair of inner second reflection plates 26B, which corresponds to the pair of second light control mirrors 25*a*2, is provided inboard of the pair of outer second reflection plates 26A.

The outer second reflection plates 26A, which are provided outboard of the inner second reflection plates 26B, reflect light emitted by the infrared heater 23 and passing through the first light control mirrors 25*a*1 toward the center portion of the fixing film 21 in the width direction of the fixing film 21. The inner second reflection plates 26B, which are provided inboard of the outer second reflection plates 26A, reflect light emitted by the infrared heater 23 and passing through the second light control mirrors 25*a*2 toward the center portion of the fixing film 21 in the width direction of the fixing film 21.

As illustrated in FIGS. 11, 12A, 12B, and 12C, a tilt angle of a reflecting surface portion of the outer second reflection plate 26A with respect to the width direction of the first reflection plate 25X is greater than a tilt angle of a reflecting surface portion of the inner second reflection plate 26B with respect to the width direction of the first reflection plate 25X. Accordingly, light reflected by the outer second reflection plates 26A reaches and irradiates the center portion of the fixing film 21 in the width direction of the fixing film 21 precisely to suppress excessive temperature increase at both ends of the fixing film 21 in the width direction of the fixing film 21.

The fixing device 20X having the above-described structure controls the transmittance of the light control mirrors under which a recording medium P does not pass to be greater than the transmittance of other light control mirrors.

For example, as illustrated in FIG. 12A, when a maximum-size recording medium P (e.g., an A3-size recording medium P) passes through the fixing device 20X, a width of the maximum-size recording medium P corresponds to a whole width of the fixing film 21 or the infrared heater 23 depicted in FIG. 11. Accordingly, a voltage of about minus 5 volt is applied to the first light control mirrors 25*a*1 and the second light control mirrors 25*a*2 to decrease transmittance of the first light control mirrors 25*a*1 and the second light control mirrors 25*a*2 to zero percent, respectively, so that the first light control mirrors 25*a*1 and the second light control mirrors 25*a*2 are in the mirror state. A whole width of the first reflection plate 25X including the two pairs of light control mirrors which are the pair of first light control mirrors 25*a*1 and the pair of second light control mirrors 25*a*2 reflects infrared rays generated by the infrared heater 23. Accordingly, light emitted by the infrared heater 23 to irradiate the fixing film 21 directly and light reflected by the first reflection plate 25X shown in broken-line arrows in FIG. 12A irradiate the fixing film 21 in the whole width of the fixing film 21 substantially uniformly. Consequently, the whole width of the fixing film 21 is heated uniformly. As a result, a toner image is fixed properly in the whole width of the maximum-size recording medium P.

By contrast, as illustrated in FIG. 12B, when a medium-size recording medium P (e.g., an A4-size recording medium P) passes through the fixing device 20X, a width of the medium-size recording medium P corresponds to the center portion of the fixing film 21 or the infrared heater 23 in the width direction of the fixing film 21 and the second light control mirrors 25*a*2. Accordingly, a voltage of about minus 5 volt is applied to the second light control mirrors 25*a*2 to decrease the transmittance of the second light control mirrors 25*a*2 to zero percent, so that the second light control mirrors 25*a*2 are in the mirror state. Simultaneously, a voltage of about plus 5 volt is applied to the first light control mirrors 25*a*1 to increase the transmittance of the first light control mirrors 25*a*1, so that the first light control mirrors 25*a*1 are in the transparent state. Accordingly, in non-feed regions provided at both ends of the first reflection plate 25X in the width direction of the first reflection plate 25X through which the medium-size recording medium P does not pass, which are regions corresponding to the first light control mirrors 25*a*1, light emitted by the infrared heater 23 and reaching the first light control mirrors 25*a*1 passes through the first light control mirrors 25*a*1 and is reflected by the outer second reflection plates 26A, respectively. Thereafter, the light passes through the first light control mirrors 25*a*1 again and irradiates the center portion of the fixing film 21 in the width direction of the fixing film 21. In a feed region through which the medium-size recording medium P passes, which corresponds to the center portion of the first reflection plate 25X in the width direction of the first reflection plate 25X and the second light control mirrors 25*a*2, light emitted by the infrared heater 23 and reaching the first reflection plate 25X is reflected by a reflecting surface portion of the first reflection plate 25X and irradiates the center portion of the fixing film 21 in the width direction of the fixing film 21.

On the other hand, as illustrated in FIG. 12C, when a small-size recording medium P (e.g., an A5 size recording medium P) passes through the fixing device 20X, a width of the small-size recording medium P corresponds to the center portion of the fixing film 21 or the infrared heater 23 in the width direction of the fixing film 21 or the infrared heater 23. Accordingly, a voltage of about plus 5 volt is applied to each of the first light control mirrors 25*a*1 and the second light control mirrors 25*a*2 to increase the transmittance of the first light control mirrors 25*a*1 and the second light control mirrors 25*a*2, so that the first light control mirrors 25*a*1 and the second light control mirrors 25*a*2 are in the transparent state. Accordingly, in non-feed regions provided at both ends of the first reflection plate 25X in the width direction of the first reflection plate 25X through which the small-size recording medium P does not pass, which are regions corresponding to the first light control mirrors 25*a*1 and the second light control mirrors 25*a*2, light emitted by the infrared heater 23 and reaching the first light control mirrors 25*a*1 and the second light control mirrors 25*a*2 passes through the first light control mirrors 25*a*1 and the second light control mirrors 25*a*2, respectively, and is reflected by the outer second reflection plates 26A and the inner second reflection plates 26B, respectively. Thereafter, the light passes through the first light control mirrors 25*a*1 and the second light control mirrors 25*a*2 again, and irradiates the center portion of the fixing film 21 in the width direction of the fixing film 21. In a feed region through which the small-size recording medium P passes, which corresponds to the center portion of the first reflection plate 25X in the width direction of the first reflection plate 25X, light emitted by the infrared heater 23 and reaching the first reflection plate 25X is reflected by a reflecting surface portion of the first reflection plate 25X and irradiates the center portion of the fixing film 21 in the width direction of the fixing film 21.

In the fixing device 20X, even when recording media P (e.g., medium-size or small-size recording media P) smaller than maximum-size recording media P pass through the fixing device 20X continuously, both ends of the fixing film 21 in the width direction of the fixing film 21 are not heated excessively. Further, even when large-size recording media P pass through the fixing device 20X immediately after the medium-size or small-size recording media P pass through the fixing device 20X, hot offset is suppressed.

When the medium-size or small-size recording medium P passes through the fixing device 20X, the outer second reflection plates 26A and the inner second reflection plates 26B reflect light emitted by both ends of the infrared heater 23 in the width direction of the infrared heater 23 under which the medium-size or small-size recording medium P does not pass toward the center portion of the fixing film 21 in the width direction of the fixing film 21 under which the medium-size or small-size recording medium P passes to heat the center portion of the fixing film 21. Thus, heat energy of the infrared heater 23 is utilized.

In the fixing device 20X, like in the fixing device 20 depicted in FIGS. 8A and 8B, the controller 6 (depicted in FIG. 1) controls the transmittance of the first light control mirrors 25*a*1 and the second light control mirrors 25*a*2 based on a detection result provided by the second temperature sensor 40B or a detection result provided by both the first temperature sensor 40A and the second temperature sensor 40B depicted in FIG. 3.

Figure 13:
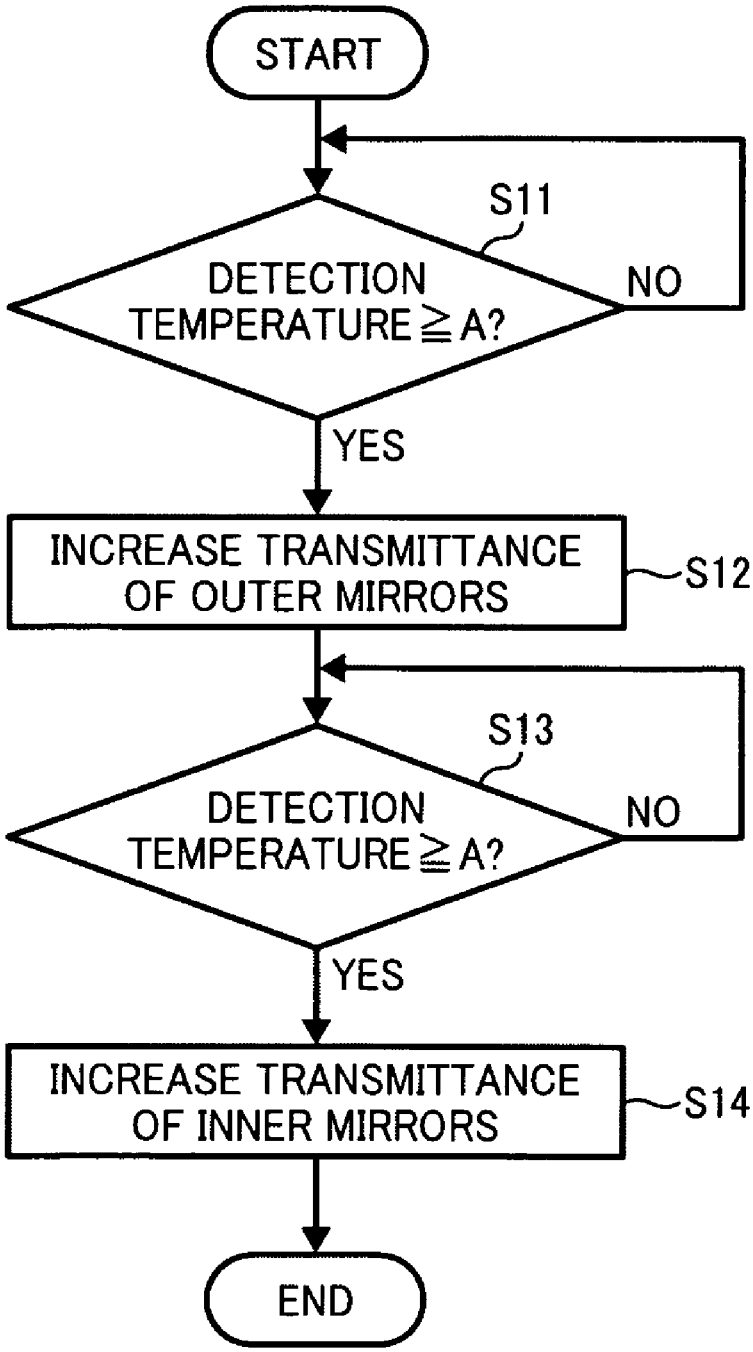
FIG. 13 is a flowchart (according to an example embodiment) illustrating control processes performed in the fixing device shown in FIG. 11.

FIG. 13 is a flowchart illustrating the control performed in the fixing device 20X. In step S11, the controller 6 (depicted in FIG. 1) judges whether or not a detection temperature detected by the second temperature sensor 40B (depicted in FIG. 3) equals to a reference temperature A or higher. When the detection temperature equals to the reference temperature A or higher (e.g., when YES is selected in step S11), the controller 6 increases the transmittance of the first light control mirrors 25*a*1 (depicted in FIG. 11) to switch the state of the first light control mirrors 25*a*1, which are outer mirrors, to the transparent state in step S12. For example, when the second temperature sensor 40B detects excessive temperature increase in one end of the fixing film 21 (depicted in FIG. 11) in the width direction, that is, the axial direction, of the fixing film 21, the controller 6 controls the first light control mirrors 25*a*1 of the first reflection plate 25X (depicted in FIG. 11) to be in the transparent state illustrated in FIG. 12B.

Thereafter, the controller 6 judges whether or not a detection temperature detected by the second temperature sensor 40B equals to the reference temperature A or higher in step S13. When the detection temperature equals to the reference temperature A or higher (e.g., when YES is selected in step S13), the controller 6 increases the transmittance of the second light control mirrors 25*a*2, which are inner mirrors, to switch the state of the second light control mirrors 25*a*2 to the transparent state in step S14. In other words, after the controller 6 controls the first light control mirrors 25*a*1 of the first reflection plate 25X to be in the transparent state illustrated in FIG. 12B, the second temperature sensor 40B may detect excessive temperature increase in one end of the fixing film 21 in the width direction of the fixing film 21. In this case, the controller 6 controls the first light control mirrors 25*a*1 and the second light control mirrors 25*a*2 of the first reflection plate 25X to be in the transparent state illustrated in FIG. 12C.

The above-described control grasps temperature distribution in both ends of the fixing film 21 in the width direction of the fixing film 21 regardless of the size of a recording medium P passing through the fixing device 20X so as to suppress excessive temperature increase in both ends of the fixing film 21 in the width direction of the fixing film 21 precisely.

As described above, in the fixing device 20X, like in the fixing device 20 depicted in FIGS. 8A and 8B, the first reflection plate 25X covers a part of the outer circumferential surface of the infrared heater 23 in the circumferential direction of the infrared heater 23 along the width direction of the infrared heater 23 for heating the fixing film 21 serving as a fixing member. The pair of first light control mirrors 25*a*1 and the pair of second light control mirrors 25*a*2 are provided in both ends of the first reflection plate 25X in the width direction of the first reflection plate 25X, respectively. As illustrated in FIGS. 12B and 12C, the outer second reflection plates 26A and the inner second reflection plates 26B reflect light emitted by the infrared heater 23 and passing through the first light control mirrors 25*a*1 and the second light control mirrors 25*a*2, respectively, toward the center portion of the fixing film 21 in the width direction of the fixing film 21. With this structure, the fixing device 20X is heated to a proper fixing temperature within a short time after the fixing device 20X is powered on. Further, the compact fixing device 20X having the relatively simple structure is manufactured at reduced costs. Even when small-size recording media P pass through the fixing device 20X continuously, both ends of the fixing film 21 in the width direction of the fixing film 21 are not heated up to an excessively high temperature. Thus, the fixing device 20X and the image forming apparatus 1 (depicted in FIG. 1) including the fixing device 20X provide improved heating efficiency for heating the fixing film 21.

As described above, the fixing device 20 depicted in FIG. 7 includes two sets of the light control mirror 25*a* and the second reflection plate 26 provided at both ends of the first reflection plate 25 in the width direction of the first reflection plate 25, respectively. Alternatively, the fixing device 20 may include one set of the light control mirror 25*a* and the second reflection plate 26 provided at one end of the first reflection plate 25 in the width direction of the first reflection plate 25. With this configuration, one side edge of a recording medium P of any size is aligned at another end of the first reflection plate 25 at which the light control mirror 25*a* and the second reflection plate 26 are not provided.

Similarly, the fixing device 20X depicted in FIG. 11 may include one set of the first light control mirror 25*a*1, the outer second reflection plate 26A, the second light control mirror 25*a*2, and the inner second reflection plate 26B provided at one end of the first reflection plate 25X in the width direction of the first reflection plate 25X.

According to the above-described example embodiments, the fixing device 20 or the fixing device 20X is installed in the image forming apparatus 1 (depicted in FIG. 1) serving as a monochrome image forming apparatus for forming a monochrome image on a recording medium. Alternatively, the fixing device 20 or the fixing device 20X may be installed in a color image forming apparatus for forming a color image on a recording medium.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a fixing member to heat and melt a toner image on a recording medium, the fixing member forming a loop;

an infrared heater opposing the fixing member to emit light to heat the fixing member;

a first reflection plate to cover a part of an outer circumferential surface of the infrared heater in a circumferential direction of the infrared heater along an axial direction of the infrared heater substantially perpendicular to the circumferential direction of the infrared heater, the first reflection plate reflecting the light emitted by the infrared heater toward the fixing member, and comprising at least one light control mirror provided in at least one end of the first reflection plate in an axial direction of the first reflection plate; and at least one second reflection plate opposing the infrared heater via the at least one light control mirror to reflect the light emitted by the infrared heater and passing through the at least one light control mirror toward a center portion of the fixing member in an axial direction of the fixing member.

2. The fixing device according to claim 1, further comprising a controller to adjust transmittance of the at least one light control mirror according to a width of the recording medium in a width direction of the recording medium, the width direction of the recording medium corresponding to the axial direction of the first reflection plate.

3. The fixing device according to claim 2, wherein the at least one light control mirror comprises a plurality of pairs of light control mirrors adjacent to each other, each of the pairs of light control mirrors comprising two light control mirrors provided in both ends of the first reflection plate in the axial direction of the first reflection plate, respectively, and wherein the controller adjusts the transmittance of the at least one pair of light control mirrors provided in a non-feed region of the fixing device through which the recording medium does not pass to be greater than the transmittance of the at least one pair of light control mirrors provided in a feed region of the fixing device through which the recording medium passes.

4. The fixing device according to claim 2, further comprising:

a first temperature detector facing the center portion of the fixing member in the axial direction of the fixing member to detect the temperature of the center portion of the fixing member; and a second temperature detector facing one end of the fixing member in the axial direction of the fixing member to detect the temperature of the one end of the fixing member, wherein the controller adjusts the transmittance of the at least one light control mirror based on a temperature detection result provided by at least the second temperature detector.

5. The fixing device according to claim 2, wherein the at least one light control mirror comprises a plurality of pairs of light control mirrors adjacent to each other, each of the pairs of light control mirrors comprising two light control mirrors provided in both ends of the first reflection plate in the axial direction of the first reflection plate, respectively, wherein the at least one second reflection plate comprises a plurality of pairs of second reflection plates opposing the plurality of pairs of light control mirrors, respectively, the plurality of pairs of second reflection plates comprising an outer pair of second reflection plates and an inner pair of second reflection plates provided inboard of the outer pair of second reflection plates, and wherein a reflecting surface portion of the outer pair of second reflection plates and a reflecting surface portion of the inner pair of second reflection plates are tilted at an angle to the axial direction of the first reflection plate, and wherein an angle of tilt of the reflecting surface portion of the outer pair of second reflection plates is greater than an angle of tilt of the reflecting surface portion of the inner pair of second reflection plates.

6. The fixing device according to claim 1, further comprising:

a pressing member to contact the fixing member; and a contact member fixedly provided inside the loop formed by the fixing member and pressed against the pressing member via the fixing member to form a nip between the fixing member and the pressing member through which the recording medium bearing the toner image passes, wherein the fixing member comprises a flexible fixing film that moves in a predetermined direction of movement, and the infrared heater, the first reflection plate, and the at least one second reflection plate are provided inside the loop formed by the flexible fixing film at a position upstream from the nip in the direction of movement of the flexible fixing film.

7. An image forming apparatus comprising:

a fixing device comprising:

a fixing member to heat and melt a toner image on a recording medium, the fixing member forming a loop;

an infrared heater opposing the fixing member to emit light to heat the fixing member;

a first reflection plate to cover a part of an outer circumferential surface of the infrared heater in a circumferential direction of the infrared heater along an axial direction of the infrared heater substantially perpendicular to the circumferential direction of the infrared heater, the first reflection plate reflecting the light emitted by the infrared heater toward the fixing member, and comprising at least one light control mirror provided in at least one end of the first reflection plate in an axial direction of the first reflection plate; and at least one second reflection plate opposing the infrared heater via the at least one light control mirror to reflect the light emitted by the infrared heater and passing through the at least one light control mirror toward a center portion of the fixing member in an axial direction of the fixing member.

8. The image forming apparatus according to claim 7, wherein the fixing device further comprises a controller to adjust transmittance of the at least one light control mirror according to a width of the recording medium in a width direction of the recording medium, the width direction of the recording medium corresponding to the axial direction of the first reflection plate.

9. The image forming apparatus according to claim 8, wherein the at least one light control mirror comprises a plurality of pairs of light control mirrors adjacent to each other, each of the pairs of light control mirrors comprising two light control mirrors provided in both ends of the first reflection plate in the axial direction of the first reflection plate, respectively, and wherein the controller adjusts the transmittance of the at least one pair of light control, mirrors provided in a non-feed region of the fixing device through which the recording medium does not pass to be greater than the transmittance of the at least one pair of light control mirrors provided in a feed region of the fixing device through which the recording medium passes.

10. The image forming apparatus according to claim 8, wherein the fixing device further comprises:

a first temperature detector facing the center portion of the fixing member in the axial direction of the fixing member to detect the temperature of the center portion of the fixing member; and a second temperature detector facing one end of the fixing member in the axial direction of the fixing member to detect the temperature of the one end of the fixing member, and wherein the controller adjusts the transmittance of the at least one light control mirror based on a temperature detection result provided by at least the second temperature detector.

11. The image forming apparatus according to claim 8, wherein the at least one light control mirror comprises a plurality of pairs of light control mirrors adjacent to each other, each of the pairs of light control mirrors comprising two light control mirrors provided in both ends of the first reflection plate in the axial direction of the first reflection plate, respectively, wherein the at least one second reflection plate comprises a plurality of pairs of second reflection plates opposing the plurality of pairs of light control mirrors, respectively, the plurality of pairs of second reflection plates comprising an outer pair of second reflection plates and an inner pair of second reflection plates provided inboard of the outer pair of second reflection plates, and wherein a reflecting surface portion of the outer pair of second reflection plates and a reflecting surface portion of the inner pair of second reflection plates are tilted at an angle to the axial direction of the first reflection plate, and wherein an angle of tilt of the reflecting surface portion of the outer pair of second reflection plates is greater than an angle of tilt of the reflecting surface portion of the inner pair of second reflection plates.

12. The image forming apparatus according to claim 7, wherein the fixing device further comprises:

a pressing member to contact the fixing member; and a contact member fixedly provided inside the loop formed by the fixing member and pressed against the pressing member via the fixing member to form a nip between the fixing member and the pressing member through which the recording medium bearing the toner image passes, wherein the fixing member comprises a flexible fixing film that moves in a predetermined direction of movement, and the infrared heater, the first reflection plate, and the at least one second reflection plate are provided inside the loop formed by the flexible fixing film at a position upstream from the nip in the direction of movement of the flexible fixing film.

13. The fixing device according to claim 1,wherein a reflecting surface portion of the at least one second reflection plate is tilted at an angle to reflect light toward the center portion of the fixing member in the axial direction of the fixing member.

* * * * *